US005510018A

United States Patent [19]

Rey

[11] Patent Number: 5,510,018

[45] Date of Patent: Apr. 23, 1996

[54] SYSTEM TO RE-CIRCULATE TREATMENT MATERIAL IN PROCESSES OF SURFACE TREATMENT AND FINISHING

[75] Inventor: Giorgio Rey, Udine, Italy

[73] Assignee: Danieli & C. Officine Meccaniche SpA, Buttrio, Italy

[21] Appl. No.: 346,304

[22] Filed: Nov. 23, 1994

[30] Foreign Application Priority Data

Nov. 30, 1993 [IT] Italy ..... UD93A0240
Apr. 8, 1994 [IT] Italy ..... UD94A0059

[51] Int. Cl.[6] ..... B01D 17/12; B05C 3/12; B05C 11/10

[52] U.S. Cl. ..... 210/97; 118/419; 118/429; 118/602; 118/603; 118/688; 137/572; 210/167

[58] Field of Search ..... 210/85, 86, 90, 210/96.1, 103, 104, 143, 167, 198.1, 175, 513; 118/419, 429, 667, 688, 692, 694, 697, 602, 603, 420; 204/141.5, 180.8; 137/571, 572; 427/345

[56] References Cited

U.S. PATENT DOCUMENTS

| | | | |
|---|---|---|---|
| 2,791,516 | 5/1957 | Chambers et al. | 118/429 |
| 2,841,111 | 7/1958 | Walker | 118/429 |
| 2,874,073 | 2/1959 | Meheney et al. | 118/429 |
| 3,130,068 | 4/1964 | Whitley | 118/429 |
| 3,730,667 | 5/1973 | Tani et al. | 118/419 |
| 3,836,441 | 9/1974 | Millington | 204/141.5 |
| 3,929,411 | 12/1975 | Takano et al. | 137/572 |
| 3,956,540 | 5/1976 | Laliberte et al. | 118/429 |
| 3,981,162 | 9/1976 | Klier | 118/419 |
| 4,126,523 | 11/1978 | Wong | 204/141.5 |
| 5,073,260 | 12/1991 | Wilkendorf | 210/341 |

FOREIGN PATENT DOCUMENTS

| | | |
|---|---|---|
| 0402270 | 6/1990 | European Pat. Off. . |
| 2167949 | 1/1973 | France . |
| 1596823 | 1/1967 | Germany . |
| 2029244 | 6/1970 | Germany . |
| 2711814 | 3/1977 | Germany . |
| 2055771 | 3/1981 | United Kingdom . |

OTHER PUBLICATIONS

Patent Abstract of Japan, vol. 13, No. 224 (C–559) (3572) 24 May 1989 & JP–A–01 036 780 (Nippon Steel) Feb. 1989.

*Primary Examiner*—Joseph W. Drodge
*Attorney, Agent, or Firm*—Antonelli, Terry, Stout & Kraus

[57] ABSTRACT

System to re-circulate the treatment material in processes of surface treatment and finishing, which can be employed in association with a pickling and/or acid washing plant (12) or in association with a plant (12) for metal-coating with heat, the plant (12) comprising at least one dip tank (13) containing the treatment material (11), which is caused to circulate advantageously in countercurrent to the material to be treated, which is advantageously strip (14), the treatment material (11) being able to consist of acid baths or molten metal, such as zinc or aluminum, the dip tank (13) comprising a discharge conduit (18) and a feeder conduit (17), the system comprising at least two vessels (**16*a*–16*b*) which can be hermetically sealed and are of a type resistant to pressure and which are positioned in parallel and associated with the discharge conduit (18) and with the feeder conduit (17), each of the vessels (16*a*–16*b*) including an independent inlet closure (20) and an independent outlet closure (19), each of the vessels (16*a*–16*b*) being associated, by way of an independent inlet valve (21) for entry of a gaseous fluid, with a plant of gaseous fluid under pressure, and, by way of a bleeder valve (22), with the atmosphere, each of the vessels (16*a*–16*b***) having a first filling condition and a second emptying condition.

22 Claims, 2 Drawing Sheets

SYSTEM TO RE-CIRCULATE TREATMENT MATERIAL IN PROCESSES OF SURFACE TREATMENT AND FINISHING

BACKGROUND OF THE INVENTION

This invention concerns a system to re-circulate treatment material in processes of surface treatment and finishing.

The re-circulation system according to the invention is employed advantageously for the re-circulation of corrosive and abrasive acid baths or for the re-circulation of molten metals.

To be more exact, the system to re-circulate treatment material according to the invention is applied to pickling plants and/or turbulent pickling plants and/or plants for pickling and electrolytic processes employed for surface treatment of metallic objects such as metallic strip.

This system to re-circulate treatment material according to the invention is used advantageously also in plants for the surface finishing of metallic objects and especially in plants in which metallic coatings applied with heat, such as galvanising and aluminising, are produced.

The state of the art includes the pickling method which has the purpose of removing from the surface of the steel the non-metallic particles and, in particular, the oxides forming on that surface.

The pickling is carried out by making the surface of the steel cooperate with inorganic acids or salts which attack the surface of the steel to be treated in a more or less intense manner.

Pickling plants for strip, with which the invention is concerned, are continuous dip plants and comprise at least one dip tank filled with a solution containing the required acid or salt in which the strip, or material to be cleaned, is immersed and caused to pass at the desired speed.

The solution generally leaves the dip tank by gravity and is collected in an underlying re-circulation vessel, whence it is drawn by re-circulation pump means so as to be re-immitted into the dip tank.

The aggressive nature of the acid solutions used in the step of pickling or acid washing of the metal reduces considerably the life of the re-circulation pumps, which therefore have to be often replaced.

With a view to increasing the life of the pumps there is also a tendency to keep the temperature of the solution at values lower than those providing maximum efficiency of the pickling process.

Moreover, the presence of abrasive particles consisting mainly of scales of metallic oxides which are detached from the metallic surface makes the working conditions of the re-circulation pumps still more severe and shortens their life even further.

This situation makes necessary a frequent operation of filtration and/or regeneration of the acid solution used in the tanks together with related costs that increase the treatment costs.

Furthermore the surface finishing plants in which the metallic coating processes with heat, such as galvanising and aluminising for instance, are carried on entail great problems with regard to the movement and re-circulation of the molten metal, which in this case is zinc or aluminium; these problems are mainly due to the high temperature and great viscosity of the molten metal.

JP-A-1-36780 and DE-A-2.711,814 disclose systems to re-circulate a solution which employ re-circulation pumps and therefore entail all the above problems.

GB-A-2,055,771 discloses an autoclave system associated with a pickling plant and performing the emptying and filling of the pickling tank. This system includes the immersion of the objects to be pickled in a tank containing an unmoving acid solution and does not allow this solution to flow in countercurrent to the materials to be treated. Moreover, this system does not enable the acid solution to be re-circulated into the tank but merely makes possible the replacement of the solution consumed, thus ensuring a substantially constant level in the dip tank.

EP-A-0.402.270 discloses a method and plant to galvanise continuously or discontinuously objects which are passed into a sealed chamber containing the galvanising solution. This chamber includes upstream and downstream closure means which enable the chamber to be kept always full of galvanising solution at a preset pressure. The sealed chamber is associated with a tank under pressure, which ensures the presence of galvanising solution in the chamber; this system permits the replacement of the solution consumed but does not make possible the continuous re-circulation of the solution. Furthermore, the immersion chamber requires upstream and downstream closure means of an electromagnetic type, which are expensive and make the structure complicated.

DE-A-2.029.244 discloses a system for the filling and emptying of a tank containing a treatment solution at the beginning and end of processing but does not enable this solution to be re-circulated continuously.

SUMMARY OF THE INVENTION

The present applicants have designed, tested and embodied this invention so as to overcome the shortcomings of the state of the art and to achieve further advantages.

The purpose of the invention is to provide a system for re-circulation of the treatment material in the surface treatment and finishing processes.

The re-circulation system according to the invention consists in bringing again into circulation the corrosive and abrasive baths coming from the tanks performing the pickling and/or chemical treatment and/or electrochemical treatment of metals.

The system according to the invention can also be used for the re-circulation of the molten metal in the tanks of plants performing metallic coating with heat, such as galvanising and aluminising.

Where the plants are performing a surface treatment such as pickling, turbulent pickling and electrolytic processes in general, the treatment materials to be re-circulated consist of acid and/or corrosive baths.

Where the metallic coating treatments with heat are being performed, the treatment materials to be re-circulated consist of molten baths of the coating metal.

The system according to the invention, when used in pickling plants, enables operations to be carried on without pumps and with acid solutions having a higher temperature and a higher content of abrasive particles.

The system according to the invention, therefore, enables the pickling times to be reduced and thus increases the output of the whole pickling plant.

Moreover, the system according to the invention makes possible an increase of the periods of use of the same acid solution before submitting that solution to filtration and/or purification treatments and thus reduces the costs of the operation.

The re-circulation system according to the invention comprises at least two vessels arranged in parallel at a level lower than that of the dip tank with which they are associated.

The dip tank includes a conduit to feed the treatment materials and a conduit to discharge the treatment materials.

The two vessels can be hermetically sealed, are of a type resistant to pressure and can be put under pressure by a suitable pressurisation system consisting, for instance, of a compressed air plant or a plant for another gas under pressure.

In the case of molten metal the pressurisation system employs an inert gas such as nitrogen to obviate occurrences of oxidation of the molten metal.

The vessels are made of a material resistant to the particular treatment material which they have to hold.

In the event of acid solutions the vessels can consist of steel internally lined with a synthetic material resistant to the aggressiveness of the acid, or of a synthetic material lined with tiles.

In the case of a liquid metal the metallic vessel is advantageously ceramic-coated internally.

Each vessel includes inlet closure means and outlet closure means, which connect the vessel respectively to the conduit for discharge of the treatment material and the conduit that feeds the treatment material.

The closure means can be associated with means providing filtration and direct heating.

Each vessel undergoes a first filling condition with the inlet closure means opened and with the outlet closure means shut, and a second emptying condition with the inlet closure means shut and with the outlet closure means opened.

The two vessels are always in counterpart conditions, so that when one is in a filling condition, the other is in an emptying condition, and viceversa.

Each vessel includes also inlet valve means for a fluid under pressure and bleeder valve means, the bleeder valve means being connected advantageously to a system for the filtering and neutralising of the acid gases before the latter are discharged into the atmosphere.

Each vessel comprises also means to monitor the level, means to monitor the internal pressure, safety means such as safety valves, minimum level sensors, visual and/or acoustic warnings, means to lock the closure means, etc.

Each vessel may also include auxiliary accessories such as heating means and/or means to filter the treatment material.

In the event of a metallic coating treatment with heat, each vessel will include heating means, of an induction type for instance, to ensure at all times a temperature higher than the melting temperature of the coating metal.

Moreover, each vessel includes advantageously stirring means, which ensure the homogeneous nature of the treatment material held in the vessel and prevent any depositing of that material on the bottom of the vessel.

In the event of a metallic coating treatment with heat both the discharge conduit and the feeder conduit for the treatment material include heating means to prevent solidification of the molten metal passing through the conduits.

A typical method of working of the system according to the invention comprises the following steps, for example:

the first vessel at atmospheric pressure and in a filling condition with the inlet closure means opened and the outlet closure means shut:

the second vessel under pressure and in a emptying condition with the inlet closure means shut and the outlet closure means opened;

when the level of the treatment material in the first vessel in a filling condition has reached the pre-set maximum level, the inlet closure means of that vessel are shut and the inlet valve means for the entry of air/nitrogen under pressure are opened to bring the internal pressure to a pre-set value;

the first vessel, now full, isolated and under pressure, is ready to feed the dip tank;

when the level in the second vessel reaches the pre-set minimum level, the outlet closure means of the second vessel are shut automatically and simultaneously and the first vessel changes to the emptying condition;

the bleeder valve means of the second vessel then open to bring the internal pressure of the second vessel to the atmospheric value;

the inlet closure means of the second vessel are opened and thus bring the second vessel to the filling condition;

the above cycle with the alternating change of a vessel from a filling condition to a emptying condition, and viceversa, is continuous and replaces the traditional system with transfer pumps.

During the step of putting the filled vessel under pressure and with both the closure means shut, the inlet valve means for the entry of air/nitrogen under pressure are opened to bring the internal pressure to a pre-set value and are then closed.

According to a variant the inlet valve means for the entry of compressed air are kept open until the internal pressure has been brought to a pre-set value, and remain open also during the whole subsequent step of emptying the vessel.

According to a first variant the system according to the invention comprises at least three vessels, of which one is feeding, another is discharging and the last is in reserve; the reserve vessel can be full of treatment material under pressure. This variant enables one vessel to be shut down, for instance for an emergency or for maintenance requirements while the treatment plant continues working normally.

The inclusion of the third reserve vessel can ensure continuity of feed of the treatment material to the dip tank without any transient delay due to the time needed to put under pressure the new feeding vessel.

The system according to the invention comprises advantageously an assembly to control and restore to the correct value the treatment material held in the various vessels so as to ensure the correct characteristics of that material.

In the event of pickling and/or chemical or electrochemical treatments, in particular, the value of acidity of the treatment material has to be ensured. In this case the assembly to control and restore to the correct value the treatment material includes advantageously an acidity (pH) sensor associated with each vessel and at least one storage tank holding the relative concentrated acid solution.

According to another variant the system comprises at least four vessels, of which two are in a filling condition and two in an emptying condition. According to this lay-out it is possible to put the two vessels in the emptying condition under pressure with differentiated pressures.

It is thus possible to feed the dip tank at the same time with two flows of treatment material at differentiated pressures; these flows are sent, for instance, to two different usage means using the same dip tank or to usage means associated with different dip tanks.

According to another variant the system according to the invention comprises at least two pairs of vessels, each pair having one empty vessel and one full vessel.

The full vessels hold treatment materials of different types.

In the case of acid baths, the baths can be different as regards different concentrations of the components or as regards different components. In this way it is possible to feed the dip tank alternatively with two flows of an acid solution of different types or of different concentrations.

This kind of system is used advantageously, for instance, in the case of pickling of stainless steel, where mixtures of nitric acid ($HNO_3$) and hydrofluoric acid (HF) are used alternatively at different concentrations.

In this case the assembly that controls and feeds the treatment material held in the respective vessels comprises at least one storage tank for each type of treatment material to be brought to the correct values.

The system according to the invention can be governed advantageously by a control device which performs automatically the operations of the above cycle together with the relative operations of opening, shutting and controlling the closure means and valve means as well as the various means associated with the vessels.

BRIEF DESCRIPTION OF THE DRAWINGS

The attached figures are given as a non-restrictive example and show a preferred embodiment of the invention as follows.

DETAILED DESCRIPTION OF THE PREFERRED EMBODIMENTS

Figure 1:
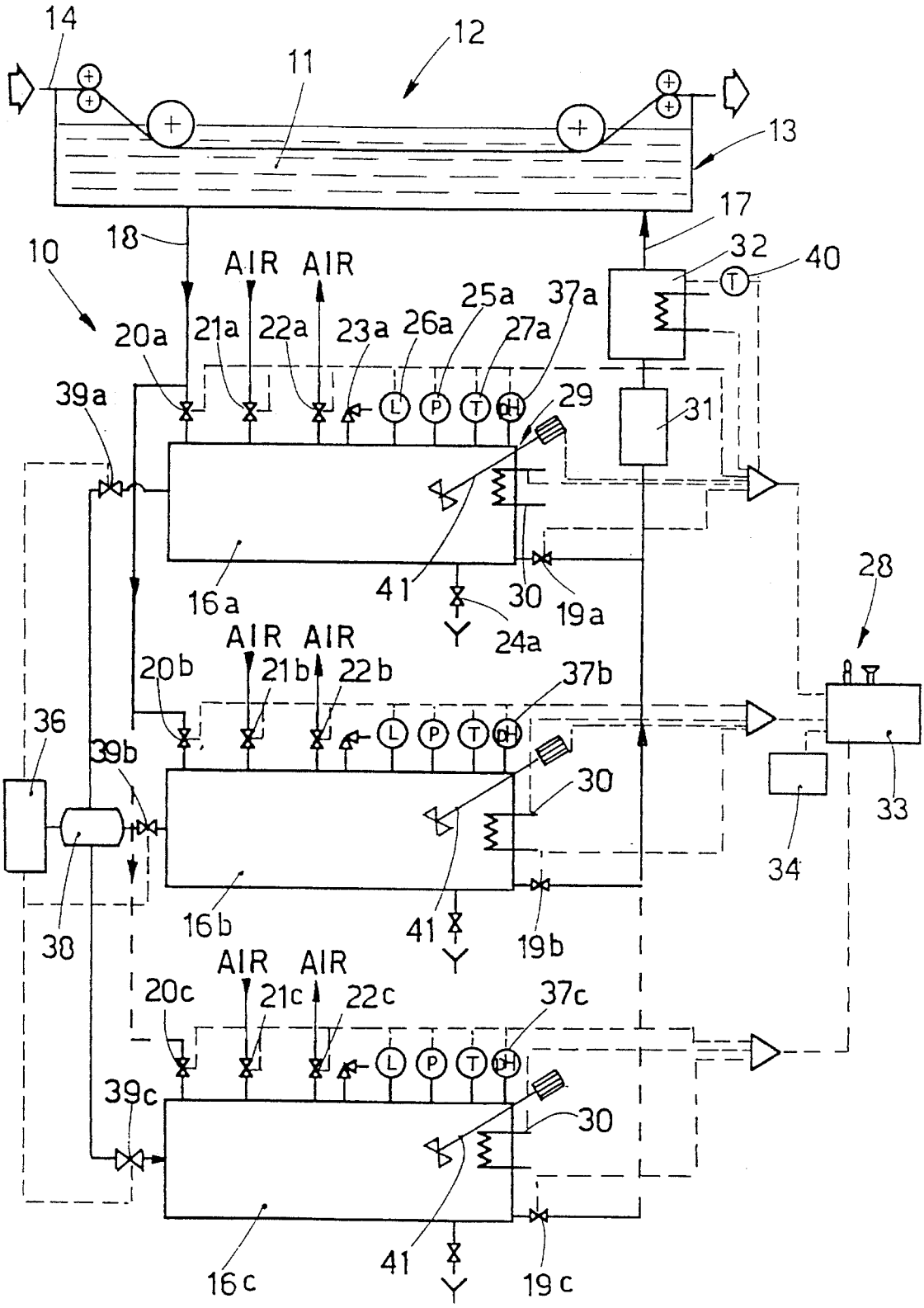
FIG. 1 is a diagram of a plant that employs the system of re-circulation of the treatment material according to the invention.

The reference number 10 in the attached figures denotes generally a system to re-circulate the treatment material in surface treatment and finishing processes according to the invention.

The plants shown in this case refer to a pickling process in which the treatment material consists of acid and/or corrosive baths 11.

The re-circulation system 10 according to the invention is applied advantageously to surface treatment and finishing plants 12 including at least one dip tank 13 containing the treatment material, which consists of the acid baths 11 or of molten metal such as aluminium or zinc and through which the material to be treated consisting of a continuous metallic strip 14 in this case is caused to pass.

The description that follows refers to a pickling plant in which the treatment material consists of an acid solution 11, but the same considerations hold good also in the case of a plant performing metallic coating with heat, in which the acid solution 11 is replaced by molten metal.

The dip tank 13 includes a conduit 17 to feed the acid solution and a conduit 18 to discharge the acid solution, the discharge conduit 18 being associated with the bottom of the dip tank 13.

The feeder conduit 17 may be associated at its end with means to distribute the acid solution, which are suitably arranged in the dip tank 13 and through which the acid solution is returned into the dip tank 13.

The re-circulation system 10 according to the invention comprises at least two vessels 16, which are respectively a first vessel **16*a* and a second vessel 16*b*** and are the same as each other and are installed in parallel.

The vessels 16 are capable of being hermetically sealed, are of a type resistant to pressure and can be put under pressure by a suitable plant containing a gas under pressure, especially compressed air, this plant not being shown here.

In the case of a plant applying a metallic coating with heat, an inert gas such as nitrogen is employed to put the vessels 16 under pressure.

The vessels 16 are made advantageously of steel internally lined with a synthetic material resistant to the acid, or else of a synthetic material internally lined with tiles or ceramic-coated.

Each vessel 16 is connected to the dip tank 13 through the feeder conduit 17 and discharge conduit 18.

Where molten metal is to be re-circulated, both the feeder conduit 17 and discharge conduit 18 include heating means which ensure that the liquid metal does not solidify within the conduits 17–18.

At each vessel 16 the feeder conduit 17 includes outlet closure means 19 and the discharge conduit 18 includes inlet closure means 20.

These respective outlet closure means 19 and inlet closure means 20 enable the relative vessel 16 to be isolated from the dip tank 13.

According to a special form of embodiment suitable to ensure correct hermetic seal engagement the closure means 19–20 are associated with means to clean abrasive impurities.

The vessels 16 are installed at a position lower than that of the dip tank 13 so that the acid bath 11 leaving the dip tank 13 through the discharge conduit 18 is fed by gravity into the vessels 16.

Each vessel 16 undergoes a first filling condition with the inlet closure means 20 opened and the outlet closure means 19 shut and a second emptying condition with the inlet closure means 20 shut and the outlet closure means 19 opened.

The two respective first **16*a* and second 16*b* vessels are always in counterpart conditions in relation to each other, so that, when one 16*a* or 16*b* is in a filling condition, the other 16*b* or 16*a*** is in an emptying condition, and viceversa.

Moreover, each vessel 16 includes:

- valve means 21 for the entry of air, which are connected to the compressed air plant (not shown here);
- bleeder valve means 22 connected to possible purification and filtration means so as to discharge into the atmosphere the acid vapours and air under pressure;
- safety valves 23 so set that they are tripped if the pressure in a vessel 16 exceeds a pre-set value;
- drainage valve means 24 located at the bottom of the vessel 16 to empty the same in the event of maintenance and/or cleaning of the vessel 16;
- pressure sensor means 25;
- level sensor means 26;
- temperature sensor means 27;
- heating/cooling means 29 consisting in this case of a cooling water pipe or an electrical heating coil 30 to adjust the temperature.

In the case of plants applying a metallic coating with heat the heating/cooling means 29 associated with the dip tank 13 are advantageously of an induction type.

According to a variant each vessel 16 includes advantageously stirrer means 41, which ensure a homogeneous condition of the treatment material, whether the latter consists of the acid baths 11 or molten metal, and which prevent the depositing of that material on the bottom of the vessel 16.

In this case the feeder conduit 17 includes filter means 31 and auxiliary means 32 to heat/cool the acid solution returned to the dip tank 13. These auxiliary heating/cooling means 32 are governed by temperature sensor means 40, which monitor the temperature of the acid solution returned to the dip tank 13.

In this case the re-circulation system 10 according to the invention in association with a pickling plant 12 comprises an assembly 36 to control and restore to the correct values the acid solution, the assembly 36 being connected to pH metres 37 (acidity sensors) associated with the vessels 16.

This controlling and restoring assembly 36 is associated with at least one storage tank 38 holding the concentrated acid solution.

By opening suitable closure valves 39 the controlling and restoring assembly 36 sends into the relative vessel 16 the required quantity of concentrated acid solution to bring the pH (acidity value) in the relative vessel 16 to the pre-set value.

The method of working of the system 10 according to the invention comprises the following steps:

- the emptying of the second vessel **16*b* in an emptying condition according to the methods described hereinafter, and the resulting feeding of the dip tank 13 by that vessel 16*b* through the feeder conduit 17**;
- the filling of the first vessel **16*a* in a filling condition with the inlet closure means 20*a* opened and the outlet closure means 19*a* shut until the desired level monitored by the level sensor 26*a*** is reached;
- the closure of the inlet closure means **20*a* and the opening of the air inlet valve means 21*a* until the desired pressure signalled by the pressure sensor 25*a* is reached in the first vessel 16*a*;**
- possible closing of the air inlet valve means **21*a*;**
- the shutting of the outlet closure means **19*b* of the second vessel 16*b* and the simultaneously change of the first vessel 16*a* to the emptying condition with the opening of the outlet closure means 19*a*;**
- the opening of the bleeder valve means **22*b* of the second vessel 16*b*** to bring its internal pressure to the atmospheric value;
- the opening of the inlet closure means **20*b* of the second vessel 16*b*,** which thus changes to a filling condition.

This cycle can be carried on continuously without problems by making the two vessels **16*a*–16*b*** alternate between a filling condition and an emptying condition, and viceversa.

According to a variant the above cycle can be governed by an automatic control assembly 33, possibly equipped with appropriate acoustic and/or sound warning means 28, which receives the signals of the pressure, level and temperature sensors 25–26–27; the control assembly 33 sends out signals to actuate the closure means 19–20 and the valve means 21–22.

This control assembly 33 can be programmed advantageously and be connected to recording means 34 so as to record all the operations and the development of the working parameters of the system.

The control assembly 33 can also actuate the heating/cooling means 29 so as to keep the temperature of the treatment material 11 in the vessel 16 at the desired value.

According to a variant the re-circulation system 10 according to the invention comprises at least a third vessel **16*c*, which acts as a buffer store and is advantageously kept full and under pressure with its relative closure means 20*c*–19*c*** shut.

The outlet closure means **19*c* are opened automatically to feed the dip tank 13 in the event of an emergency or during maintenance of one of the other vessels 16**.

According to yet another variant the vessels 16 are more than three in number, and at least one of them is in a filling condition and at least one in an emptying condition.

Figure 2:
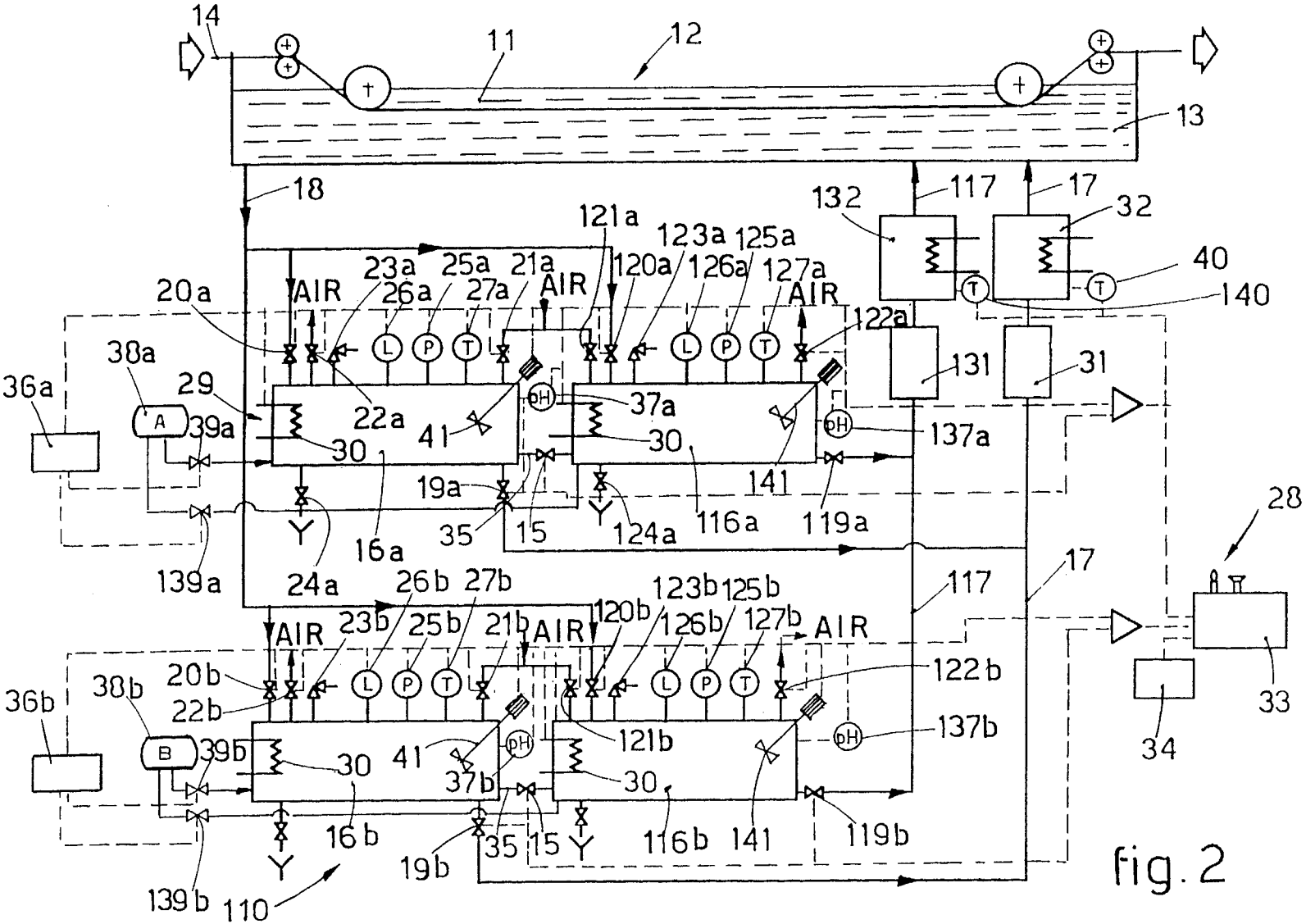
FIG. 2 is a diagram of a variant of the plant that employs the system of re-circulation of the treatment material according to FIG. 1.

According to a further variant shown in FIG. 2 the re-circulation system 110 comprises at least two pairs of vessels 16, namely **16*a*–116*a* and 16*b*–116*b***.

While the pair of vessels **16*a*–116*a* is in a filling condition, the pair of vessels 16*b*–116*b*** is in an emptying condition, and viceversa.

Both the pairs of vessels **16*a*–116*a* and 16*b*–116*b* are connected to the same one discharge conduit 18**, through which they are filled at different times according to the methods described above.

In this case the vessels 16 and 116 forming a pair are connected together by an intermediate connecting conduit 35, to which are fitted connecting valve means 15.

The connecting valve means 15 are opened during the filling step to provide the same level in the two vessels 16 and 116 belonging to a pair and are shut when the level reaches the pre-set value.

The vessels **16*a* and 16*b* are connected to a first feeder conduit 17, whereas the vessels 116*a* and 116*b* are connected to a second feeder conduit 117**.

By means of the system 110 it is possible to put the vessels **16*a*–116*a* or 16*b*–116*b* under different pressures when they are full. In this way it is possible, under particular working conditions, to feed the dip tank 13 with two currents of acid baths under different pressures, the currents being fed through the feeder conduits 17 and 117** respectively.

Likewise, according to what has been described earlier, the vessels 116 are associated with respective inlet closure means 120 and outlet closure means 119.

Moreover, the vessels 116 in the system 110 comprise all the aforesaid components and accessories described with regard to the vessels 16 of the system 10 of FIG. 1, such as, in particular, air inlet valves 121, air bleeder valves 122, safety valves 123, drainage valves 124, pressure sensors 125, level sensors 126 and temperature sensors 127.

Furthermore, the feeder conduit 117 is equipped with the relative filter means 131 and auxiliary heating/cooling means 132, the latter being governed by relative temperature sensors 140.

Besides, the vessels 116 comprise relative pH metres 137 associated with means 36 to restore the acid solution to its correct values, the latter means 36 being complemented by relative closure valves 139.

Relative stirrer means 141 are also included.

In the case of the pickling plant 12 shown in FIG. 2 the re-circulation system 110 can also be used advantageously to feed the dip tank 13 with two acid solutions A and B of different types or of the same type but at different concentrations.

In this example the pair of vessels **16*a*–116*a* is associated with one type of acid solution A, whereas the other pair of vessels 16*b*–116*b*** is associated with another type of acid solution B.

As we said above, the acid solution A can be different from the acid solution B as regards their concentrations and/or as regards their composition.

For instance, in the event of pickling treatment of stainless steel the solution A and the solution B consist of a mixture of nitric acid ($HNO_3$) and hydrofluoric acid (HF) at different concentrations.

The different acid solutions A and B can be fed alternatively to the dip tank 13 to submit the strip 14 to differentiated pickling treatments.

In particular, while the acid solution A is fed to the dip tank 13, the vessel 16*a* (or 116*a*) is in a filling condition whereas the the vessel 116*a* (or 16*a*) is in an emptying condition.

In this situation the other pair of vessels 16*b*–116*b* is isolated from the dip tank 13 as the closure valve means 20*b*–120*b*–19*b*–119*b* are shut.

Both the pairs of vessels 16*a*–116*a* and 16*b*–116*b* are connected to the same one discharge conduit 18, through which the respective acid solution A or B is caused to re-circulate within the respective vessel 16–116 according to the methods described above.

In the next step the dip tank 13 is fed with the acid solution B according to the above methods, while the pair of vessels 16*a*–116*a* will be isolated from the dip tank 13 by the shutting of the closure valve means 20*a*–120*a*–19*a*–119*a*.

I claim:

1. A recirculation system to recirculate treatment material in processes of surface treatment and finishing, comprising:

a dip tank containing a liquid treating material, the dip tank connected to a discharge conduit for discharging treating material therefrom by gravity and a feeder conduit for feeding treating material thereto and comprising means for passing metallic objects through the tank;

a source of gaseous fluid under pressure; and at least two vessels operably connected in parallel to one another and being provided below the dip tank, each of the at least two vessels being hermetically sealable, being resistant to pressure and being connected to the discharge conduit through an openable inlet closure means, to the feeder conduit through an openable outlet closure means, and to the source of gaseous fluid through an inlet valve, each of the at least two vessels communicating with a bleeder valve to discharge gaseous fluid from the vessel, wherein each vessel has a first filling condition for receiving therein the liquid treating material discharged by gravity from the dip tank through the discharge conduit and a second emptying condition for emptying liquid treating material therefrom and propelling the liquid treating material to the dip tank through the feeder conduit by pressure of the gaseous fluid.

2. Re-circulation system as in claim 1, further comprising a control assembly to control the system such that when one vessel is in the first filling condition with its inlet closure means open and with its outlet closure means shut, another vessel is in the second emptying condition with its inlet closure means shut and with its outlet closure means open, and viceversa.

3. Re-circulation system as in claim 1, in which each bleeder valve is connected to a system to treat and neutralize acid fumes.

4. Re-circulation system as in claim 1, in which each vessel includes at least a pressure sensor, a level sensor and a temperature sensor.

5. Re-circulation system as in claim 4, in which each vessel includes an acidity sensor.

6. Re-circulation system as in claim 4, further comprising an automatic control assembly which receives signals from the pressure, level and temperature sensors and sends signals to control and actuate the inlet and outlet closure means and the inlet and bleeder valves.

7. Re-circulation system as in claim 6, in which the control assembly comprises acoustic and/or visual warning means.

8. Re-circulation system as in claim 1, in which each vessel includes means to stir the treatment material therein.

9. Re-circulation system as in claim 1, in which each vessel includes means to heat/cool the treatment material contained therein.

10. Re-circulation system as in claim 1, which comprises at least a third vessel positioned in parallel with the other vessels and acting as a buffer stock vessel by being kept full and under pressure.

11. Re-circulation system as in claim 1, in which at least one vessel is replaced by at least one pair of vessels connected to the same one discharge conduit, each of the pair of vessels being also connected to a respective feeder conduit, the one discharge conduit and the respective feeder conduits being associated with respective inlet closure means and outlet closure means.

12. Re-circulation system as in claim 11, in which, for each pair of vessels the vessels are kept under differentiated pressures.

13. Re-circulation system as in claim 11, in which, for each pair of vessels the vessels contain treatment materials of different types as regards concentration and/or composition.

14. Re-circulation system as in claim 11, in which each pair of vessels includes a connecting conduit, which is associated with a connecting valve and connects one vessel of said pair to the other vessel of said pair constituting the pair.

15. Re-circulation system as in claim 14, in which, for each pair of vessels the connecting valve is opened during a first filling condition and closed before pressurisation by opening the inlet valves.

16. Re-circulation system as in claim 1, in which the respective closure means are associated with means to clean abrasive impurities.

17. Re-circulation system as in claim 1, which comprises an assembly to control and feed concentrated acid solution to the vessels, the assembly being associated with at least one tank that stores the concentrated acid solution.

18. Recirculation system as in claim 1, wherein the dip tank comprises an acid bath used for surface treatment of metallic strip.

19. Recirculation system as in claim 1, wherein the treatment material comprises molten metal for surface finishing of the metallic objects.

20. Re-circulation system as in claim 19, further comprising means for heating the feeder conduit and/or discharge conduit.

21. Recirculation system as in claim 19, wherein the molten metal comprises zinc or aluminum.

22. Recirculation system as in claim 1, wherein the means for passing comprises means for passing continuous metallic strip through the dip tank containing the liquid treating material.

* * * * *